US005265582A

United States Patent [19]

Bhogal

[11] Patent Number: 5,265,582

[45] Date of Patent: Nov. 30, 1993

[54] CONTROLLING THE VELOCITY OF PROJECTILES FROM GAS-POWERED GUNS

[76] Inventor: Mohan Bhogal, 699 Willowbank Trail, Mississauga, Ontario, Canada, L4W 3L6

[21] Appl. No.: 833,498

[22] Filed: Feb. 10, 1992

[51] Int. Cl.[5] ..... F41B 11/06; F41B 11/32

[52] U.S. Cl. ..... 124/73; 124/74

[58] Field of Search ..... 137/505.42; 124/68-71, 124/73, 74, 76

[56] References Cited

U.S. PATENT DOCUMENTS

| | | | |
|---|---|---|---|
| 2,594,240 | 4/1952 | Wells | 124/70 X |
| 2,635,599 | 4/1953 | Wells | 124/76 X |
| 2,777,456 | 1/1957 | Ey | 137/505.42 X |
| 3,113,432 | 12/1963 | Watson | 137/505.42 X |
| 4,304,213 | 12/1981 | Jereckos | 124/69 |
| 4,349,043 | 9/1982 | Christensen | 137/505.42 |
| 4,616,622 | 10/1986 | Milliman | 124/73 |
| 4,982,758 | 1/1991 | Schlachter | 137/505.42 |
| 5,113,898 | 5/1992 | White et al. | 137/505.42 X |
| 5,123,436 | 6/1992 | Koechlein et al. | 137/505.42 X |

FOREIGN PATENT DOCUMENTS

| | | | |
|---|---|---|---|
| 443246 | 11/1974 | U.S.S.R. | 124/74 |

*Primary Examiner*—Randolph A. Reese
*Assistant Examiner*—John Ricci
*Attorney, Agent, or Firm*—Mirek A. Waraksa

[57] ABSTRACT

A gas-powered gun fires a projectile at a settable velocity unaffected by substantial increases in the operating pressure of a gas cartridge. The gun has a compartment for accumulating a charge of gas. The compartment includes a chamber whose inlet is controlled by a valve member normally in a closed state. A biasing spring urges a piston assembly within the chamber to deflect the valve member to an open state, allowing pressurized gas flow from the cartridge to the chamber. The pressure of the accumulating gas charge urges the piston assembly away from the valve member. The gas accumulated in the compartment attains only a predetermined threshold when the valve member returns to its closed state. A trigger-controlled discharge valve releases the accumulated gas charge at the threshold pressure into the barrel to fire the projectile. A manually-operable mechanism allows adjustment of the pressure threshold by compressing or expanding the biasing spring thereby setting the expected velocity of a projectile fired from the gun.

3 Claims, 3 Drawing Sheets

CONTROLLING THE VELOCITY OF PROJECTILES FROM GAS-POWERED GUNS

FIELD OF THE INVENTION

The invention relates generally to gas-powered guns, and more specifically, to setting and maintaining the velocity at which a projectile is fired from such guns.

BACKGROUND OF THE INVENTION

Gas-powered guns are well known. Nowadays they are used in mock combat. The object is to fire a paint pellet to strike a combatant, the released paint indicating a hit.

One example of such a gun is to be found in Canadian patent No. 1,264,128 issued on Jan. 2, 1990 and citing Aldo Perrone as the inventor. A lower barrel of the gun receives a paint pellet. An upper barrel receives a gas cartridge required to fire the pellet. The gas cartridge is automatically pierced and placed in communication with the gas flow channels when inserted into the upper barrel. A discharge valve located in the lower barrel receives pressurized gas from the cartridge. A trigger mechanism causes the valve to release the gas in a sudden burst through a low resistance flow path into the barrel upstream of the paint pellet.

The velocity of the paint pellet is preferably about 300 feet per second. Such velocities provide realistic play, but the impact of the projectile can be accommodated by conventional protective gear. The gun will be appropriately configured to produce that barrel velocity when operated with a gas cartridge with a fixed pressure rating. The pressure within the cartridge is effectively the pressure applied by the discharge valve momentarily to the paint pellet. Problems arise when the cartridge is exposed to high ambient temperatures. The gas pressure of the cartridge can increase dramatically, and the paint projectile may fire at an unexpectedly high velocity. Combatants are then exposed to serious risk of injury. Also, individuals, whether in mock combat or target competitions, are required to compete on an equal basis. Higher barrel velocities can provide an advantage to some, whether attributable to pressure increases in gas cartridges or variations between weapons.

Measures have been proposed to regulate projectile velocity in gas-powered guns. A velocity adjuster may be used. It obstructs the flow path between the discharge valve and the projectile, restricting gas flow. A set screw permits the degree of flow restriction to be adjusted and consequently the velocity attained by a projectile. However, projectile velocity remains dependent on the pressure of the gas source after initial setting of the adjuster. A significant change in source pressure in response to ambient temperatures produces a corresponding change in velocity. Another approach involves use of a spring-biased pressure relief valve. Basically, if pressure within the gun exceeds an adjustable threshold, gas is discharged to the environment. There are two shortcomings to such an approach. First, the pressure relief valve causes a pronounced hissing that is unacceptable in mock combat. Second, gas is simply wasted.

Such problems have long been recognized, but a satisfactory solution does not appear to have been proposed. The present invention addresses such problems.

SUMMARY OF THE INVENTION

In one aspect, the invention provides a gas-powered gun adapted to propel a projectile at a settable velocity independent of pressure increases in the gas source used. The gun comprises a compartment for accumulating a charge of gas under pressure. A gas delivery path allows a flow of pressurized gas from the source to an inlet of the compartment. A discharge valve communicates with the compartment, and a trigger mechanism actuates the discharge valve to release at least a portion of the accumulated gas charge into the barrel to propel the projectile. Means are provided for controlling accumulation of the gas charge within the compartment such that the charge attains only a preset pressure threshold. The control means include a valve member controlling flow of the pressurized gas through the inlet into the compartment. The valve member is displaceable between a closure orientation in which it prevents the pressurized gas flow and an open orientation in which it enables the flow. Actuating means displace the valve member to its open orientation when the pressure of the accumulated gas is less than the preset pressure threshold and to its closure orientation when the pressure of the accumulated gas rises to the threshold. Means are provided for setting the magnitude of the pressure threshold.

The firing of the projectile is an exceedingly brief event. The discharge valve in a most conventional gun momentarily exposes the projectile to the pressure of the gas source and that determines the velocity of the projectile. According to the invention, the compartment supplying the discharge valve accumulates a charge of gas at a pressure independent of the gas source. Increases in the operating pressure of the gas source, arising for example, with high ambient temperature, no longer affect the firing velocity. By adjusting the pressure threshold, the firing velocity of the gun can in fact be set to a desired value.

Other aspects of the invention will be apparent from a description below of a preferred embodiment and will be more specifically defined in the appended claims. It should be noted that for purposes of this specification, the term "gun" encompasses a revolver, rifle and similar weapons.

DESCRIPTION OF THE DRAWINGS

The invention will be better understood with reference to drawings in which:

It should be noted that details such as complementary screw threads and O-rings have been omitted in FIG. 1 and only principal components have been indicated, in view of the scale of the drawing. FIG. 3 has been similarly simplified. Details of construction of the more significant features of the invention are provided in FIGS. 2 and 4.

DESCRIPTION OF PREFERRED EMBODIMENTS

Figure 1:
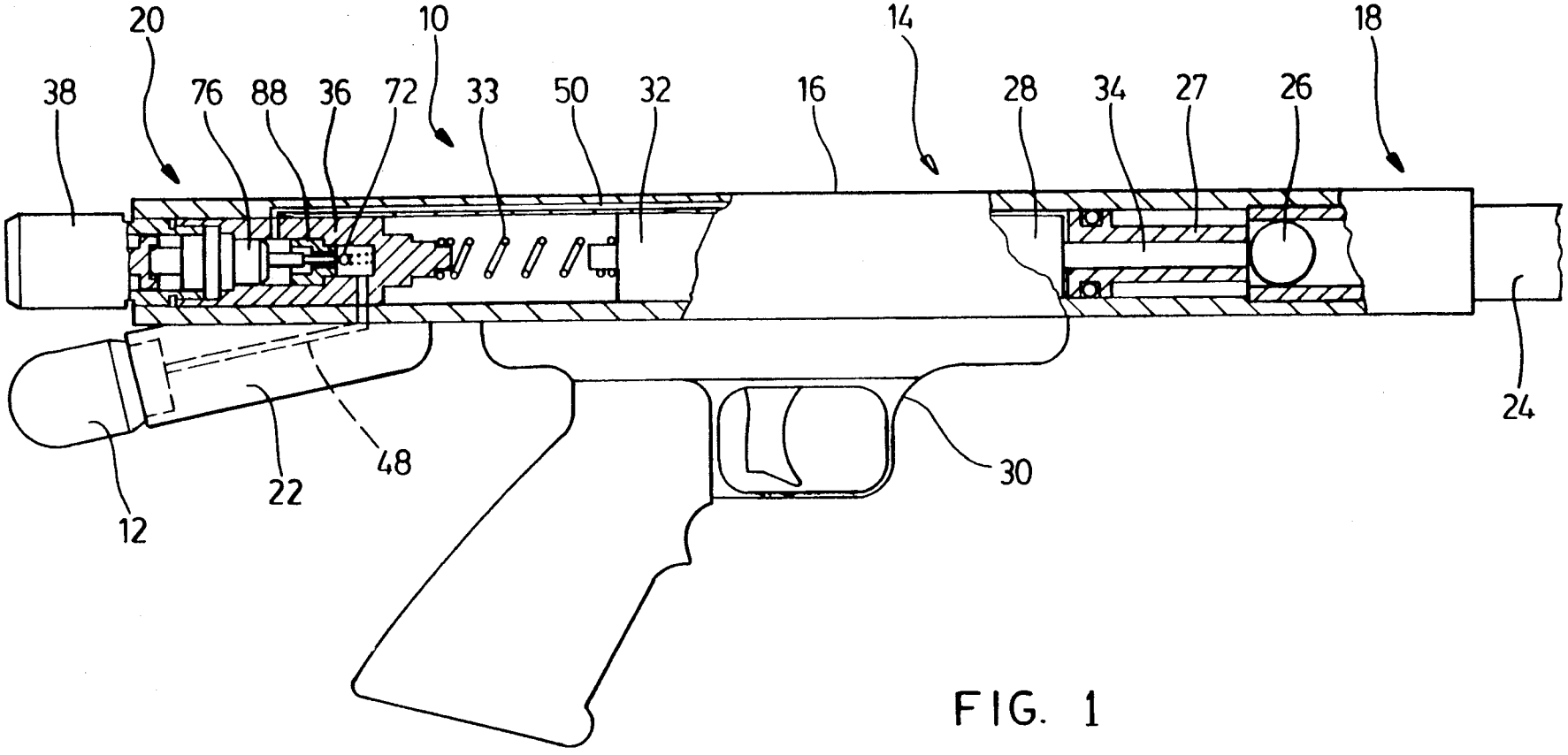
FIG. 1 is a fragmented elevation of a gun embodying the invention.

FIG. 1 illustrates a gun 10 operable with a gas cartridge 12. A general description of the gun 10 will be provided before focussing on inventive features. The gun 10 comprises a casing 14 with a circumferential sidewall 16, a forward casing portion 18, and a rear casing portion 20. The rear casing portion 20 includes a sleeve 22 that receives the gas cartridge 12 and contains a conventional mechanism (not illustrated) for piercing the cartridge 12 upon receipt in the sleeve 22 and directing pressurized gas into flow channels associated with the gun 10. The forward casing portion 18 defines the barrel 24 of the gun 10 and is adapted to receive a spherical paint pellet 26 that is deposited in the barrel 24 by a conventional ball dropper (only one component 27 of the dropper being apparent in FIG. 1.) A discharge valve 28 is located within the casing sidewall 16. It has the construction of the discharge control valve described in Canadian patent No. 1,264,128, but a variety of alternative valves can be used. A conventional trigger mechanism 30 controls the discharge valve 28. The trigger mechanism 30 includes a hammer 32 that is located within the casing 14 rearwardly of the discharge valve 28 and is biased by a spring 33 to displace forwardly. When the trigger mechanism 30 is actuated, the biasing spring 33 forces the hammer 32 to strike the discharge valve 28. The valve 28 then momentarily releases gas through discharge tube 34, which extends centrally through the ball dropper component 27, into the barrel 24 immediately upstream of the pellet 26. The construction and operation of the components of the gun 10 described above are conventional and will not be described in further detail.

The gun 10 is designed to accumulate a gas charge from the cartridge 12 and ensure that the accumulated gas charge has a particular, preset pressure. More specifically, there is an internal housing comprising forward and rear housing portions 36, 38. The two housing portions 36, 38 are axially aligned and secured to one another with complementary internal and external screw threads 40, 42. The rear housing portion 38 is formed with a separate external screw thread 44. It mates with an internal screw thread 46 formed in the rear casing portion 20 to permit convenient mounting of the mechanism in stationary position rearwardly of the hammer 32. The housing is immediately coupled to gas flow paths of the gun, specifically to a gas delivery path 48 leading from the gas cartridge 12 and gas discharge path 50 to the discharge valve 28, upon insertion of the housing into the rear casing portion 20.

The forward housing portion 36 has a forward transverse wall 52 and a rear transverse wall 54. A partitioning member 56 is secured in the interior of the forward housing portion 36 with an external screw thread 58 that mates with a complementary internal screw thread 60 of the sidewall of the forward housing portion 36. The partitioning member 56 effectively defines an internal transverse wall that divides the interior of the forward housing portion 36 into a forward chamber 62 and a rear chamber 64. The rear chamber 64 is expandable, as discussed more fully below, and serves to accumulate the charge of gas under pressure.

Figure 2:
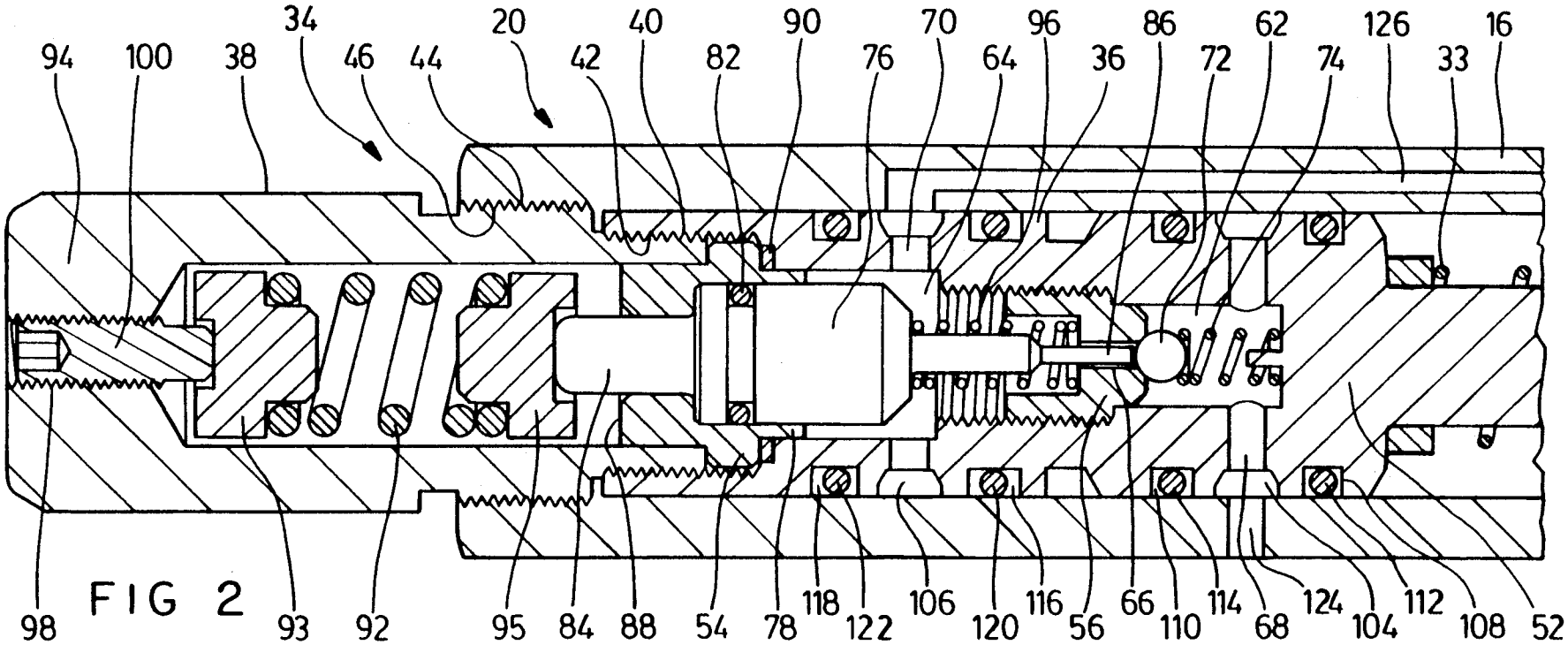
FIG. 2 is a cross-sectional view in a vertical plane of an expandable gas accumulation chamber of the gun.
Figure 3:
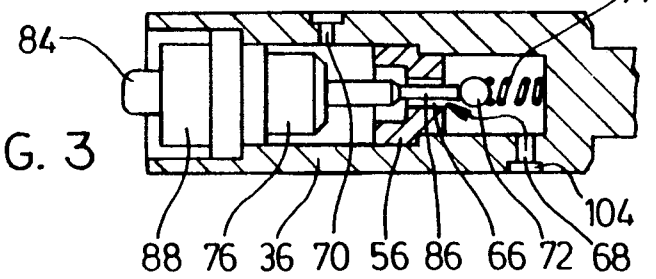
FIG. 3 is a cross-sectional view illustrating a piston assembly associated with the gas accumulation chamber, displacing a valve member to an open orientation; and, FIG. 4 is an exploded perspective view of the various components associated with the gas accumulation chamber.
Figure 4:
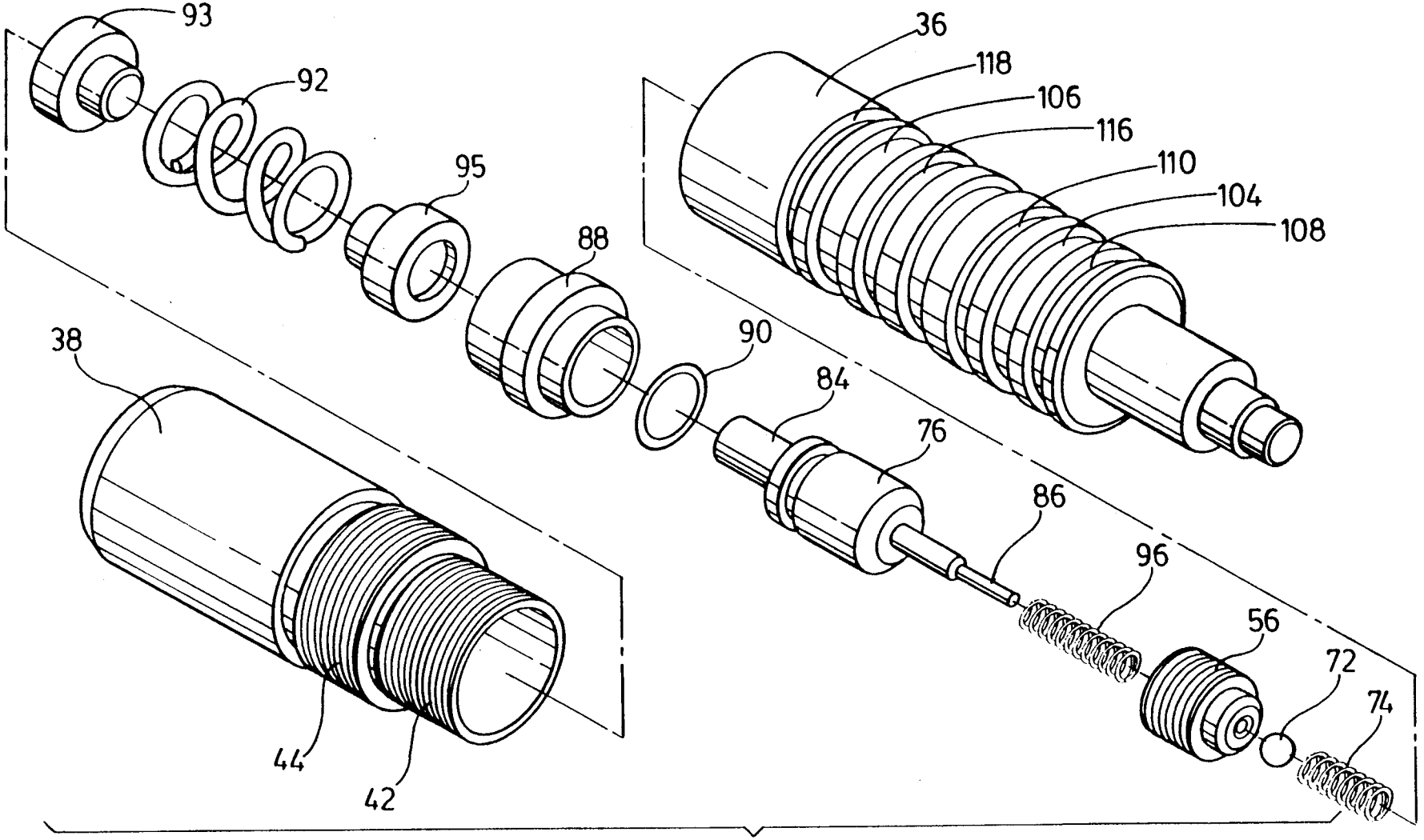

An inlet 66 to the rear chamber 64 is formed in the partitioning member 56 and communicates with the forward chamber 62. The sidewall of the forward housing portion 36 defines a forward opening 68 accessing the forward chamber 62 and ultimately placing the forward chamber 62 in the gas delivery path 48 leading from the gas cartridge 12. The sidewall also defines a rear opening 70 accessing the rear chamber 64 and placing it in communication with the flow path 50 leading to the discharge valve 28. A valve ball 72 is located within the forward chamber 62 and is associated with a biasing spring 74 that urges the ball 72 rearwardly toward the inlet 66. In FIG. 2, the valve ball 72 is shown in a closure orientation in which it seals the inlet 66. In FIG. 3, the valve ball 72 is shown in open orientation in which it permits pressurized gas from the cartridge 12 to flow through the inlet 66 into the rear chamber 64.

A piston assembly 76 in the rear chamber 64 controls the orientation of the valve ball 72. The rear wall 54 of the forward housing portion 36 includes an annular guide structure 78 surrounding a central aperture 80 in the rear wall 54. The structure 78 guides displacement of the piston assembly 76 along an axis intersecting the inlet 66. The piston assembly 76 is sealed to the interior of the guide structure 78 with an O-ring 82 to provide conventional piston action. The pressure of gas within the rear chamber 64 tends to expand the chamber and urge the piston assembly 76 rearwardly away from the inlet 66. The guide structure 78 allows a rearward projection 84 of the piston assembly 76 to extend axially through the aperture 80 in the rear wall 54, where it is ultimately accessible from the interior of the rear housing portion 38. A forward projection 86 of the piston assembly 76 extends along the axis toward the inlet 66. The piston assembly 76 has a forward position (FIG. 3) in which it engages and displaces the valve ball 72 to its open state. Displacement of the piston assembly 76 rearwardly causes the valve ball 72 to return to its closure orientation under the influence of its biasing spring 74.

It should be noted that the rear wall 54 of the forward housing portion 36 is a separable item 88 that engages an annular internal shoulder within the forward housing portion 36. A washer 90 between the rear wall 54 and the shoulder 88 is compressed when the forward and rear housing portions 36, 38 are threaded together to prevent gas leakage.

A coil spring 92 is mounted within the rear housing portion 38. It acts between the rear transverse wall 94 of the rear housing portion 38 (through an end cap 93) and the rearward projection 80 of the piston assembly 76 (through an end cap 95) to urge the piston assembly 76 forward toward the inlet 66 and effectively applies a contracting force to the rear chamber 64. A small spring 96 within the compartment acts between the interior of the compartment and the piston assembly 76 to counterbalance the larger coil spring 92. Its purpose is largely to reduce chatter.

The coil spring 92 effectively counterbalances the force applied to the piston assembly 76 by the gas charge accumulating in the rear chamber 64. With the valve ball 72 in its open orientation, pressurized gas from the cartridge 12 flows into the rear chamber 64 and gas pressure in the chamber 64 rises, driving the piston assembly 76 rearwardly with increasing force. The coil spring 92 is incidentally compressed and applies an increasing force that tends to resist the rearward movement. At a certain point, the piston assembly 76 allows the valve ball 72 to restore to its closed orientation. The pressure attained in the rear chamber 64 is related directly to the extent to which the coil spring 92 is compressed.

The pressure threshold at which the inlet 66 is sealed by the valve ball 72 can be set by adjusting the length of the coil spring 92, either compressing or expanding the spring 92. To that end, the rear transverse wall 94 of the rear housing portion 38 has a threaded opening 98. A set screw 100 is threaded into the opening 98 and engages a rear end portion of the spring 92 through the end cap 93. Manual rotation of the set screw 100 in opposing direction either compresses or expands the coil spring 92, increasing or decreasing the pressure threshold that the gas charge accumulating in the chamber 64 attains between successive firings.

The housing is very conveniently placed in communication with both the gas cartridge 12 and the discharge valve 28. Forward and rear annular grooves 104, 106 are formed in the sidewall of the forward housing portion 36, overlaying respectively the forward and rear housing openings 68, 70. The forward groove 104 cooperates with the inner surfaces of the casing sidewall 16 to define a forward annular chamber (not numbered) communicating with the forward opening 68. A pair of annular grooves 108, 110, one to either side of the forward groove 104, carry O-rings 112, 114 that seal that chamber. Another pair of annular grooves 116, 118 carrying O-rings 120, 122 similarly isolate the rear groove 106 and a rear chamber (not numbered) effectively defined by the rear groove 106 and internal casing surfaces. The gas delivery path 48 includes a path segment 124 internal to the casing sidewall 16 that communicates with the forward annular groove 104. The gas delivery discharge path 50 is a conduit formed internally to the casing sidewall 16 and places the rear annular groove 106 in communication with the discharge valve 28. The coupling of the discharge flow path 50 to the discharge valve 28 involves a groove and O-ring arrangement similar to that described above. The flow paths internal to the casing 14 can be formed by longitudinal and lateral drilling and appropriate plugging of open ends.

The operation of the gun 10 will be described from prior to installation of the gas cartridge 12. The expandable rear chamber 64 is contracted under the influence of the external coil spring 92. The forward projection 86 of the piston assembly 76 has displaced the valve ball 72 to its open state (as in FIG. 3). When the gas cartridge 12 is installed, pressurized gas flows into the forward chamber 62, through the inlet 66, and into the rear chamber 64. This causes a rearward displacement of the piston assembly 76 and expansion of the rear chamber 64. When the pressure of the accumulating gas charge reaches the threshold set by the external coil spring 92, the forward projection 86 of the piston assembly 76 allows the valve ball 72 to seal the inlet 66 (as in FIG. 2), preventing further inflow of pressurized gas in the rear chamber 64. Although the foregoing description has focussed largely on accumulation of gas within the rear chamber 64, it will be appreciated that there is effectively a compartment within the gun comprising the rear chamber 64, the flow path 50 to the discharge valve 28, and whatever internal chamber the discharge valve 28 provides, that now contains a charge of gas at the preset pressure threshold. When the trigger mechanism 30 is operated, the discharge valve 28 releases a portion of the gas charge within that compartment into the barrel 24, immediately upstream of the pellet 26. The valve ball 72 assumes its open orientation in response to the momentary discharge of gas, restoring the gas charge with the compartment to the preset pressure threshold, before the next firing of the gun 10.

If the pressure of the gas cartridge 12 increases in response to ambient temperature, the pressure to which pellets are exposed is largely unaffected. Moreover, manual operation of the set screw 100 permits that pressure and consequently the firing velocity to be adjusted at any time, totally independent of the operating pressure of the gas cartridge 12. The set screw 100 may be replaced with a rotary dial cooperating with a calibrated indicator plate to give a better indication of the actual velocity setting of the gun.

With regard to more specific features of the preferred embodiment, it will be noted that the gas accumulating chamber and mechanism are achieved without obtrusive projections that would impair practical use of the gun 10. They simply screw into place as a single unit into the rear casing portion 20. Connections to the gas circuit of the gun 10 are established immediately, and the velocity setting mechanism is conveniently located at the rear of the gun 10. The spring-biased hammer 32 can advantageously act between the forward housing portion 36 of the mechanism and the discharge valve 28.

It will be appreciated that a particular embodiment of the invention has been described and that modifications may be made therein without departing from the spirit of the invention or necessarily departing from the scope of the appended claims.

I claim:

1. A gas-powered gun adapted to propel a projectile at a settable velocity independent of pressure increases in a gas source operating the gun, comprising:

an elongate casing comprising a portion defining a barrel for receiving the projectile and an open rear casing portion;

a connector attached to the casing and configured to receive a gas cartridge;

a discharge valve positioned within the casing to discharge gas into the barrel rearwardly of the received projectile;

a housing dimensioned for insertion into the casing through the open rear casing portion, the housing defining a chamber for accumulating a charge of gas under pressure, an inlet communicating with the chamber for introduction of gas under pressure into the chamber, and an outlet communicating with the chamber for discharge of gas under pressure from the chamber, the housing comprising means for controlling accumulation of the gas charge within the chamber such that the gas charge attains only a preset pressure threshold, the accumulation controlling means comprising:

(a) a valve member controlling flow of pressurized gas through the inlet into the chamber, the valve member being displaceable between a closure orientation which prevents the pressurized gas flow and an open orientation which enables the pressurized gas flow, (b) actuating means for displacing the valve member to its open orientation when the pressure of the accumulated gas charge is less than the pressure threshold and to its closure orientation when the pressure of the accumulated gas charge rises to the pressure threshold, and (c) setting means for setting the magnitude of the pressure threshold;

means for releasably securing the housing to the casing with the housing located within the open rear housing portion and the setting means accessible rearwardly of the open rear casing portion, the securing means permitting the housing to be inserted into and removed from the casing through the open rear casing portion;

means defining a first gas delivery path for delivery of gas under pressure from the gas cartridge to the inlet and defining a second gas delivery path for delivery of gas under pressure from the outlet to the discharge valve; and, a trigger mechanism attached to the casing for actuating the discharge valve to release pressurized gas into the barrel thereby to propel the projectile.

2. The gun of claim 1 in which:

the housing comprises forward and rear axially—aligned housing portions releasably secured to one another with complementary screw threads;

the forward housing portion comprises a circumferential sidewall formed with an internal screw thread, a forward transverse wall, a rear transverse wall comprising an aperture, and a partitioning member formed with an external screw thread releasably threaded to the internal screw thread of the sidewall, the partitioning member dividing the interior of the forward housing portion to define a forward chamber and a rear chamber which constitutes the said chamber for accumulating the gas charge, the sidewall comprising a forward opening accessing the forward chamber and a rear opening which accesses the rear chamber and constitutes the outlet;

the rear housing portion comprises a circumferential sidewall and a rear transverse wall;

the valve member is mounted within the forward chamber;

the actuating means comprise:

(a) a spring mounted within the forward chamber and urging the valve member rearwardly toward the inlet, (b) a piston assembly located within the rear chamber, the piston assembly comprising a rearward projection and a forward projection, (c) a piston guide structure formed with the rear transverse wall of the forward housing portion and guiding movement of the piston assembly along an axis intersecting the inlet, the guide structure supporting the piston assembly with its rearward projection extending through the aperture of the rear transverse wall of the forward housing portion and its forward projection extending along the axis toward the inlet, the piston assembly being sealed to the guide structure such that the pressure of the accumulated gas charge urges the piston assembly rearwardly away from the inlet, and (d) a coil spring mounted within the rear housing portion and acting against the rearward projection of the piston assembly thereby to urge the piston assembly forwardly toward the inlet;

the means defining the first and second gas delivery paths comprise a plurality of seals mounted on the exterior of the forward housing portion and cooperating with inner surfaces of the casing to define a forward annular chamber overlaying the forward opening and a rear annular chamber overlaying the rear opening and comprise a first conduit formed within a wall of the casing and communicating with the forward annular chamber and a second conduit formed within a wall of the casing and communicating with the rear annular chamber; and, the securing means comprise an external screw thread formed on the rear housing portion and releasably threaded into an internal screw thread formed within the rear casing portion.

3. The gun of claim 2 in which the setting means comprise:

a threaded opening formed in the rear transverse wall of the rear housing portion; and, a rotary member formed with an external screw thread threaded into the threaded opening and engaged with a rear end portion of the coil spring within the rear housing portion such that manual rotation of the rotary member compresses or extends the coil spring.

* * * * *